US008378918B2

(12) United States Patent
Sherwood et al.

(10) Patent No.: US 8,378,918 B2
(45) Date of Patent: Feb. 19, 2013

(54) REMOVABLE AZIMUTH FINE ADJUSTMENT TOOL AND METHOD FOR A SATELLITE DISH ANTENNA SYSTEM

(75) Inventors: William John Sherwood, West Burlington, IA (US); Brian Steven Zihlman, Mt. Pleasant, IA (US); Donald F. Kerr, Burlington, IA (US); John Francis Whooley, Burlington, IA (US)

(73) Assignee: Winegard Company, Burlington, IA (US)

( * ) Notice: Subject to any disclaimer, the term of this patent is extended or adjusted under 35 U.S.C. 154(b) by 724 days.

(21) Appl. No.: 12/557,291

(22) Filed: Sep. 10, 2009

(65) Prior Publication Data

US 2010/0073257 A1 Mar. 25, 2010

Related U.S. Application Data

(60) Provisional application No. 61/099,067, filed on Sep. 22, 2008.

(51) Int. Cl.
*H01Q 3/02* (2006.01)
*H01Q 1/12* (2006.01)

(52) U.S. Cl. ..... 343/882; 343/890; 343/892

(58) Field of Classification Search ..... 343/878, 343/880, 882, 890, 892; 248/511, 519, 521, 248/534, 274.1
See application file for complete search history.

(56) References Cited

U.S. PATENT DOCUMENTS 6,956,526 B1 10/2005 Lundstedt, Jr. et al.
7,142,168 B1 11/2006 Sinclair
2005/0052335 A1* 3/2005 Chen ..... 343/878

OTHER PUBLICATIONS

HN System—Installation Manual for .74 m Ku-band Upgradeable Antenna Model AN6-074P, Oct. 19, 2006, pp. 44-52, Revision B, Hughes Network Systems, LLC, Germantown, Maryland.

* cited by examiner

*Primary Examiner* — Robert Karacsony
(74) *Attorney, Agent, or Firm* — Dorr, Carson & Birney PC

(57) ABSTRACT

A fine azimuth adjustment tool and method for a satellite antenna system having a clamp with opposing jaws for clamping around the mast pipe, a lever connected to the clamp for opening and closing the opposing jaws; a cam with a protrusion engaging a formed slot in the mast clamp when said opposing jaws are closed, the protrusion rotating the mast clamp when the cam is turned, the protrusion in the slot holding the mast clamp to the mast pipe at a desired fine tuned azimuth position while the mast clamp is tightened and secured to the mast pipe.

7 Claims, 9 Drawing Sheets

Fig. 6
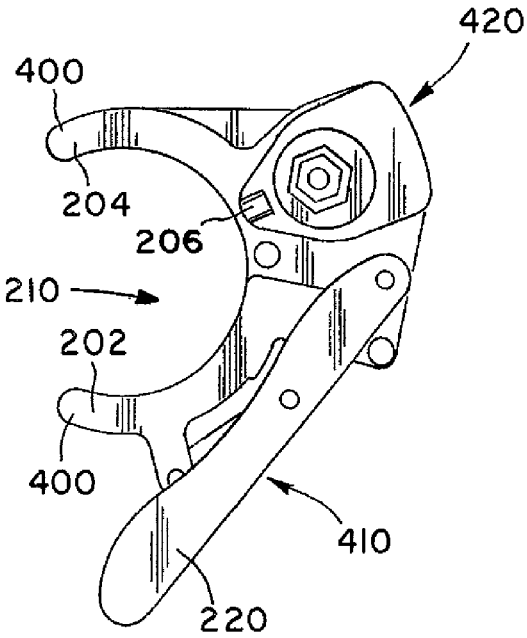
Fig. 7
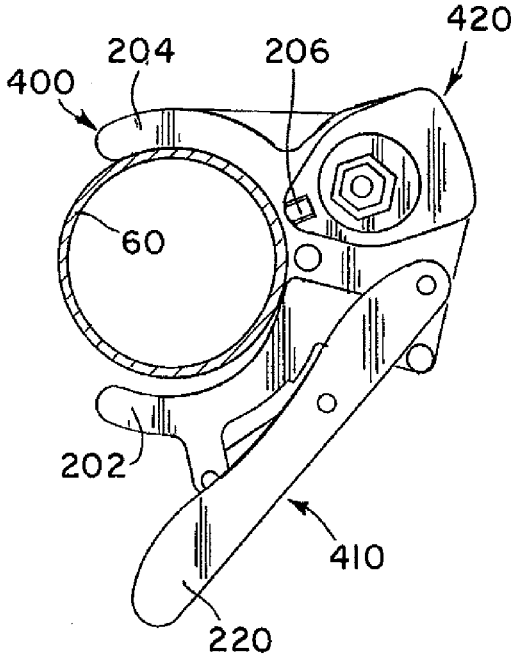
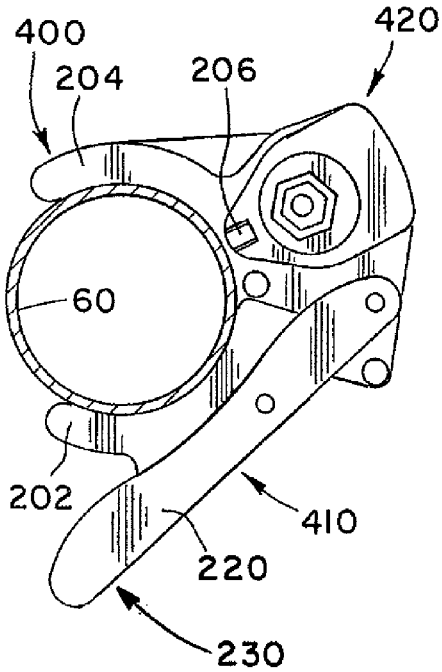
Fig. 8
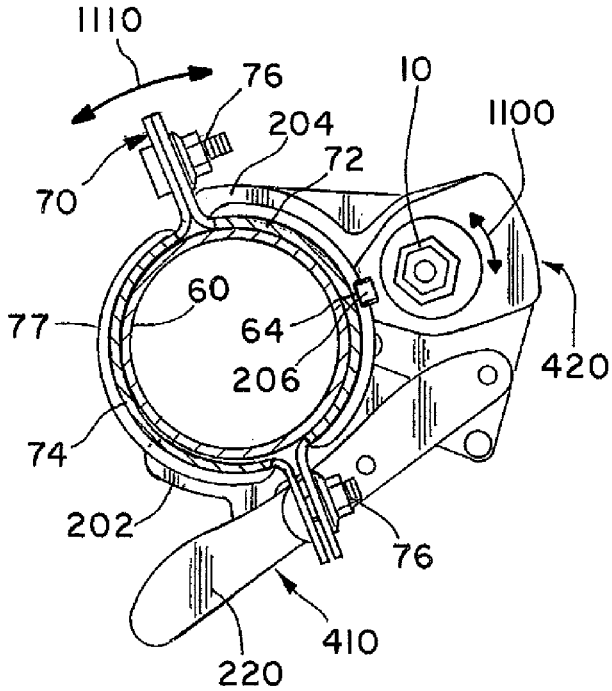
Fig. 9

REMOVABLE AZIMUTH FINE ADJUSTMENT TOOL AND METHOD FOR A SATELLITE DISH ANTENNA SYSTEM

PRIORITY CLAIM

This application claims priority to U.S. Provisional Patent Application Ser. No. 61/099,067 filed Sep. 22, 2008 which is hereby incorporated by reference in its entirety.

BACKGROUND OF THE INVENTION

1. Field of the Invention

The present invention relates to azimuth adjustment of a satellite dish antenna system during installation and, in particular, to a removable tool for azimuth fine adjustment of satellite dish antennas.

2. Discussion of the Background

Residential satellite antenna systems are common and are available from one supplier or customer to another with differences pertaining to size, cost, design, performance and application. Many such conventional satellite antenna systems require mechanisms for providing fine tune azimuth adjustments on satellite antenna mounts by installers. Generally these mechanisms are usually permanently attached to each satellite antenna mount resulting in a fixed overhead cost of manufacture. Millions of satellite antennas are in use primarily for residential reception having these permanently mounted mechanisms. Fine azimuth tuning is necessary to target the satellite antenna on the desired satellite(s) especially with larger antenna sizes and when a multi-satellite feedhorn is used. Conventional adjustment of the azimuth fine tune mechanism is typically performed by using mechanical hand tools. A continuing need exists to reduce the manufacturing costs of such satellite antennas.

Removal of the fine tune azimuth tune mechanism as a permanent fixture results in a manufacturing cost savings. On prior mounting systems, removal of the fine tune azimuth adjustment mechanism involved loosening bolts or nuts with hand tools, removing the bolts and nuts, and removing the fine tune adjustment mechanism. In some designs, the fine tune adjustment mechanism is permanently attached to the mount, and is not easily removed or serviceable. Replacement of the satellite antenna mount would be required in these designs. A need exists to reduce the cost of each individual satellite antenna mounting system by manufacturing such mounts without fine tune azimuth adjustment mechanisms.

U.S. Pat. No. 6,956,526 sets forth an azimuth adjustment mechanism which allows an installer to fine tune the azimuth of a satellite antenna through an iterative process and then to remove both the azimuth dither plates and the azimuth adjustment mechanism from the mount for use on other satellite antenna systems. This approach requires a separate permanently installed azimuth movement mechanism on the mount which engages the removable adjustment mechanism.

Hughes Network Systems sets forth a method of loosening three canister nuts enough to cause the mount to rotate on the support post, using hands to manually rotate the mount until pointed in the approximate azimuth heading, turn the mount to the right about $\frac{1}{8}^{th}$ inch, let go, count to five until a reading is obtained, this iterative process is repeated until the highest quality signal is obtained, and then the canister nuts are tightened. See "HN System—Installation Guide for 0.74 m Ku-band Upgradeable Antenna Model ANG-074P," Oct. 19, 2006, pgs 44-52. In addition to reducing manufacturing costs, the time it takes for installers to install and align a satellite antenna to target satellite(s) is critical. A continuing need also exists in the field for installers to perform azimuth alignment as quickly as possible.

A need exists for a simple tool that quickly mounts and releases for fine azimuth tuning without the use of any permanently mounted azimuth structure and which eliminates hand adjustment of the mount itself.

Finally, a need exists for a tool designed for not only a residential satellite antenna used for the home satellite reception market, but also for antenna mounting systems used in commercial applications as well. A tool design that can be modified for use in many different satellite antenna system shapes and sizes, with various feed configurations including single and multiple feed antennas, for various mount configurations.

SUMMARY OF THE INVENTION

A fine azimuth adjustment tool for a satellite antenna system having a mast pipe and a mast clamp. The mast clamp being firmly connected to the satellite antenna system. The fine azimuth adjustment tool includes a clamp having opposing jaws for clamping around the mast pipe near one end of the mast pipe; a lever connected to the clamp for opening and closing the opposing jaws about said mast pipe; and a cam having a protrusion connected to the clamp. The protrusion engages a slot near the bottom of the mast clamp when the opposing jaws are closed with the slot over the mast pipe. The engagement of the protrusion provides fine azimuth adjustment of the satellite antenna system between the mast pipe and the mast clamp when the cam is turned by a tool such as a wrench. The protrusion in the slot further holds the mast clamp to the mast pipe at the desired fine tuned azimuth position while the mast clamp is tightened and secured to the mast pipe. The lever is then opened to release the azimuth adjustment tool from the mast pipe through the open mouth after attachment.

A method for fine tuning azimuth in a satellite dish antenna placed on a mast pipe includes the steps of engaging a protrusion on the fine azimuth adjustment tool in a formed slot of the mast clamp of the satellite dish antenna; clamping jaws of the tool around the mast pipe to hold the protrusion in the formed slot; moving the mast clamp in the azimuth direction when a cam in the tool connected to the protrusion is turned to fine tune the azimuth of the satellite dish antenna; tightening the mast clamp to the mast pipe after fine tuning of the azimuth is complete; and then releasing the jaws of the tool from the mast pipe.

The summary set forth above does not limit the teachings of the invention especially as to variations and other embodiments of the invention as more fully set out in the following description taken in connection with the accompanying drawings.

BRIEF DESCRIPTION OF THE DRAWINGS

FIG. 6 is a top view of the tool of the invention corresponding to FIG. 2.

FIG. 7 is a top view of the tool of FIG. 6 open around the mast pipe corresponding to FIG. 3.

FIG. 8 is a top view of the tool of FIG. 6 closed around the mast pipe corresponding to FIG. 4.

FIG. 9 is a top view illustrating the open tool of FIG. 6 positioned towards the formed slot in the mast clamp corresponding to FIG. 5.

DETAILED DESCRIPTION OF THE INVENTION

Figure 1:
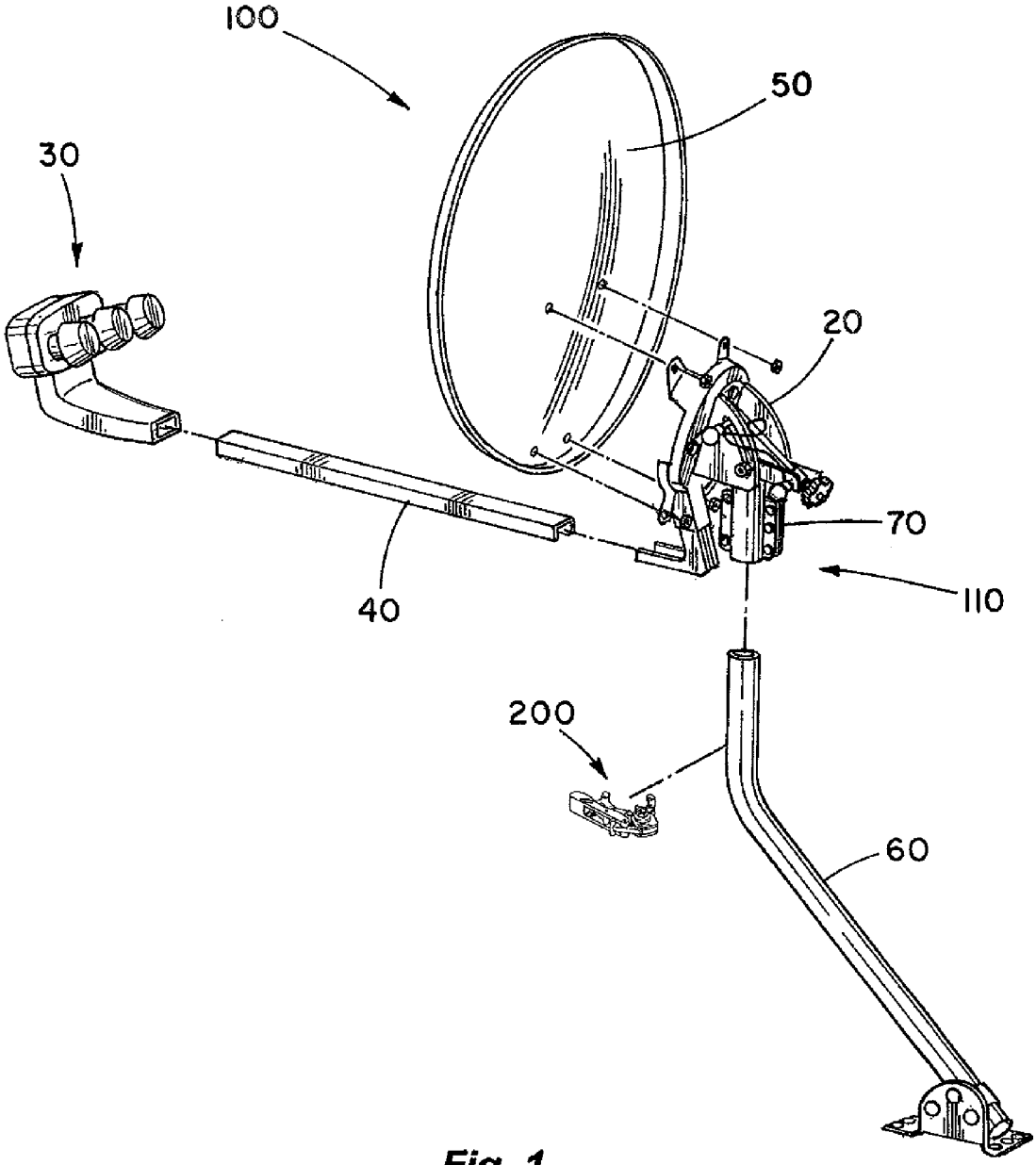
FIG. 1 is an exploded perspective view of a satellite antenna system with the azimuth fine adjustment tool of the invention.

FIG. 1 illustrates the components of a conventional satellite antenna 100. The satellite antenna 100 conventionally has a feedhorn 30 such as a multi-satellite feedhorn. A feed arm 40 holds the feedhorn 30 to a mount 20. The mount 20 in turn is connected to a satellite antenna reflector 50. A roof/wall mast pipe 60 is used to mount the assembled feedhorn 30, feed arm 40, mount 20 and reflector 50 to a roof, wall, post, or any convenient support (not shown). A mast clamp 70 connects the mount 20 to the mast pipe 60. The satellite antenna 100 shown is but one conventional approach. The tool 200 of the invention is also shown and can be used with other satellite antenna designs other than that shown in FIG. 1.

Figure 2:
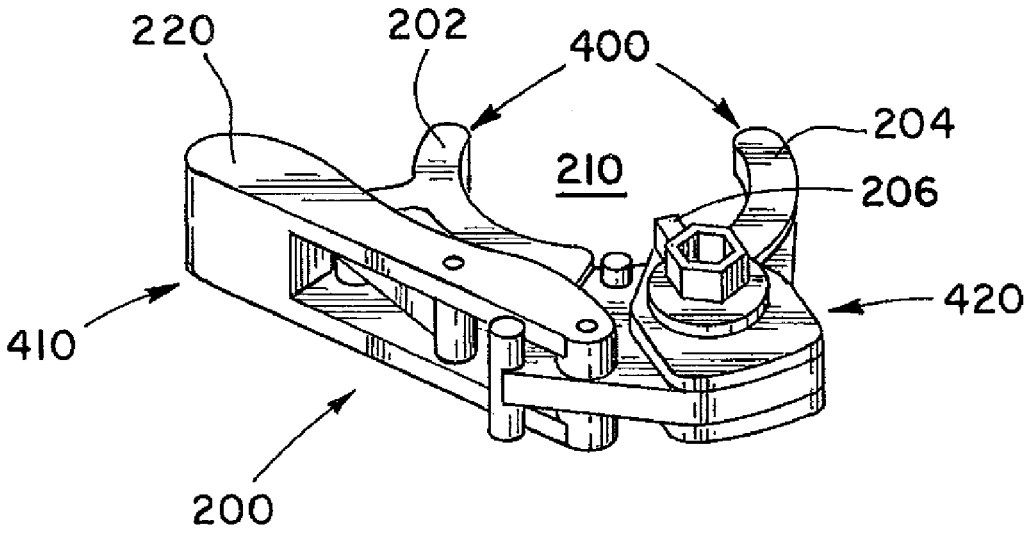
FIG. 2 is a perspective view of the tool of the invention.
Figure 3:
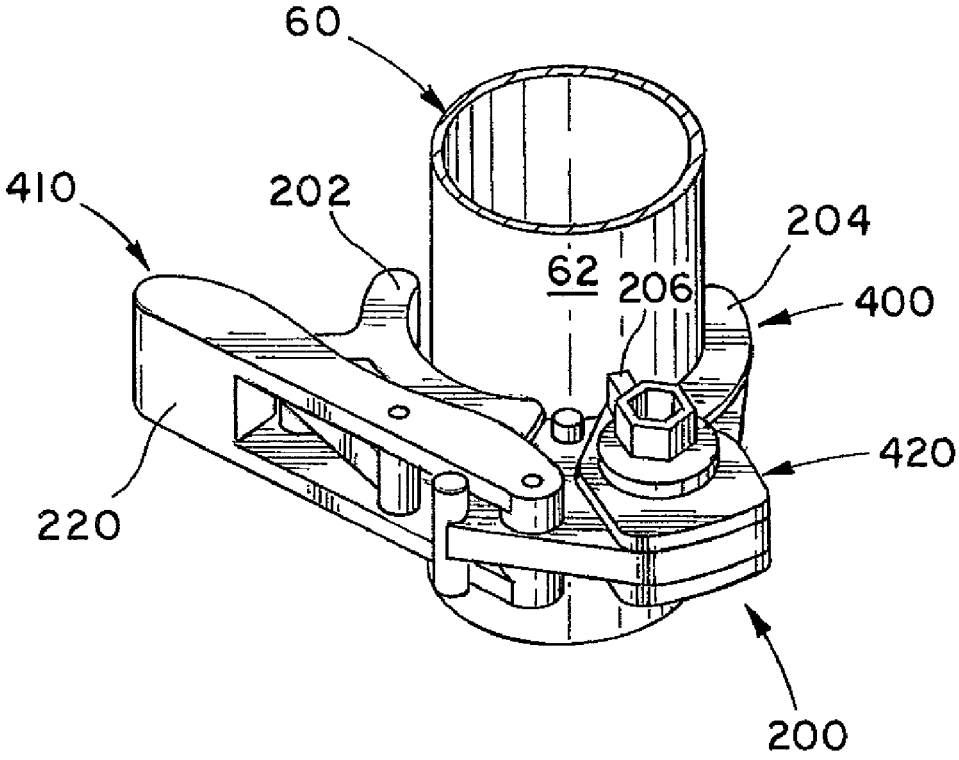
FIG. 3 is a perspective view of the tool of FIG. 2 open around the mast pipe.
Figure 4:
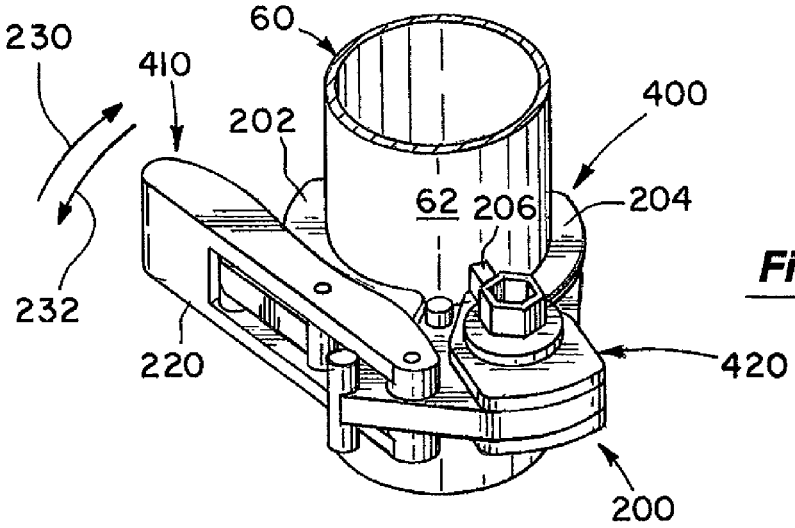
FIG. 4 is a perspective view of the tool of FIG. 2 closed around the mast pipe.

In FIGS. 2-4, the fine tune azimuth tool 200 is shown having a clamp 400, a lever 410, and an azimuth cam 420.

In FIG. 2 the clamp 400 of the fine tune azimuth tool 200 is shown with a pair of opposing jaws 202, 204 in an open position forming a mouth 210. FIG. 3 illustrates the orientation of the tool 200 by a installer so that the open mouth 210 engages around the outside 62 of the mast pipe 60. The opposing jaws 202, 204 do not encircle the mast pipe although in some-designs this could occur. In FIG. 4, the installer moves the handle 220 of the lever 410 in direction 230 to close opposing jaws 202, 204 firmly against the outside 62 of the mast pipe 60. To release the tool 200 from the mast pipe 60, the handle 220 of lever 410 is moved in the direction 232 to open opposing jaws. In this fashion, the installer can clamp and unclamp the tool 200 from the mast pipe 60.

Figure 5:
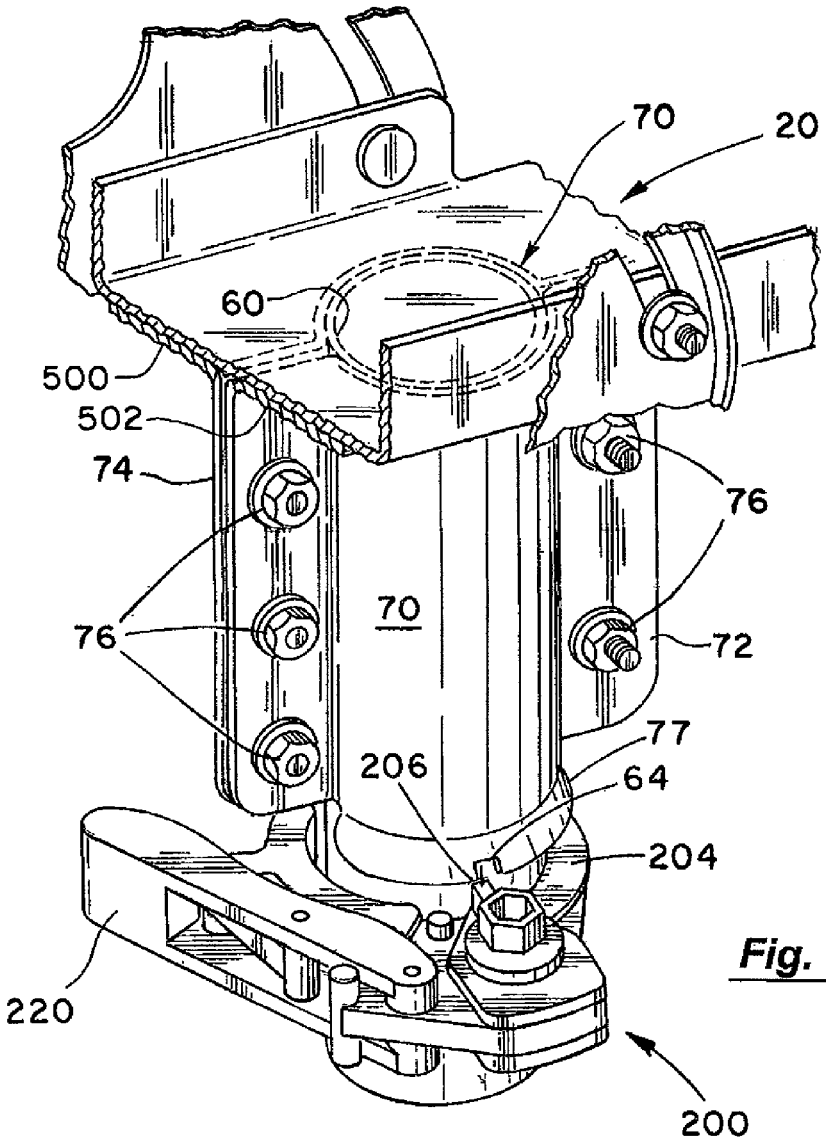
FIG. 5 is a perspective view illustrating the open tool of FIG. 2 positioned towards a formed slot in the mast clamp.

As shown in FIG. 5, the installer orients the tool 200 so that a slot 64 formed in a skirt 77 around the bottom of the mast clamp 70 aligns with and engages a protrusion 206 located on the azimuth cam 420 of the tool 200. In FIG. 5, the tool 200 is shown slightly away from the slot 64 for drawing clarity. The mast clamp 70 has two sides 72 and 74 connected together with bolts & nuts 76 to securely squeeze the mast clamp sides 72 and 74 to the mast pipe 60 after azimuth fine tuning occurs. The mast clamp sides 72 and 74 together have the formed arcuate skirt 77 which contains the formed slot 64. Final tightening and securing of the mast clamp sides 72 and 74 is done after the azimuth fine tune adjustment is done as discussed later. How to arrive at proper fine azimuth tuning is well understood.

FIG. 5 shows the mount 20 to which the mast clamp 70 is attached (the bolts attaching the upper lips 500 and 502 of sides 72 and 74 are not shown). The mast clamp 70 is attached to the mount 20 a number of different conventional ways. What has been added is the formed slot 64 in the skirt 77. Some conventional mast clamps 70 have skirts 77 so slots 64 are added. If a skirt 77 is not present, then a skirt 77 or other member is added to provide a good slot 64 opening.

FIGS. 6 through 9 correspond to FIGS. 2 through 5 from a top view. FIG. 6 shows the opposing jaws 202 and 204 of lever 410 in the open mouth 210 position. FIG. 7 shows the open mouth 210 around the mast pipe 60. In FIG. 8, the handle 220 is moved in direction 230 to tighten the jaws 202 and 204 against the mast pipe 60. Finally in FIG. 9, the protrusion 206 is shown inserted into the slot 64 of the mast skirt 77 (FIG. 5 is different as the slot 64 is slightly offset for clarity).

Figure 10:
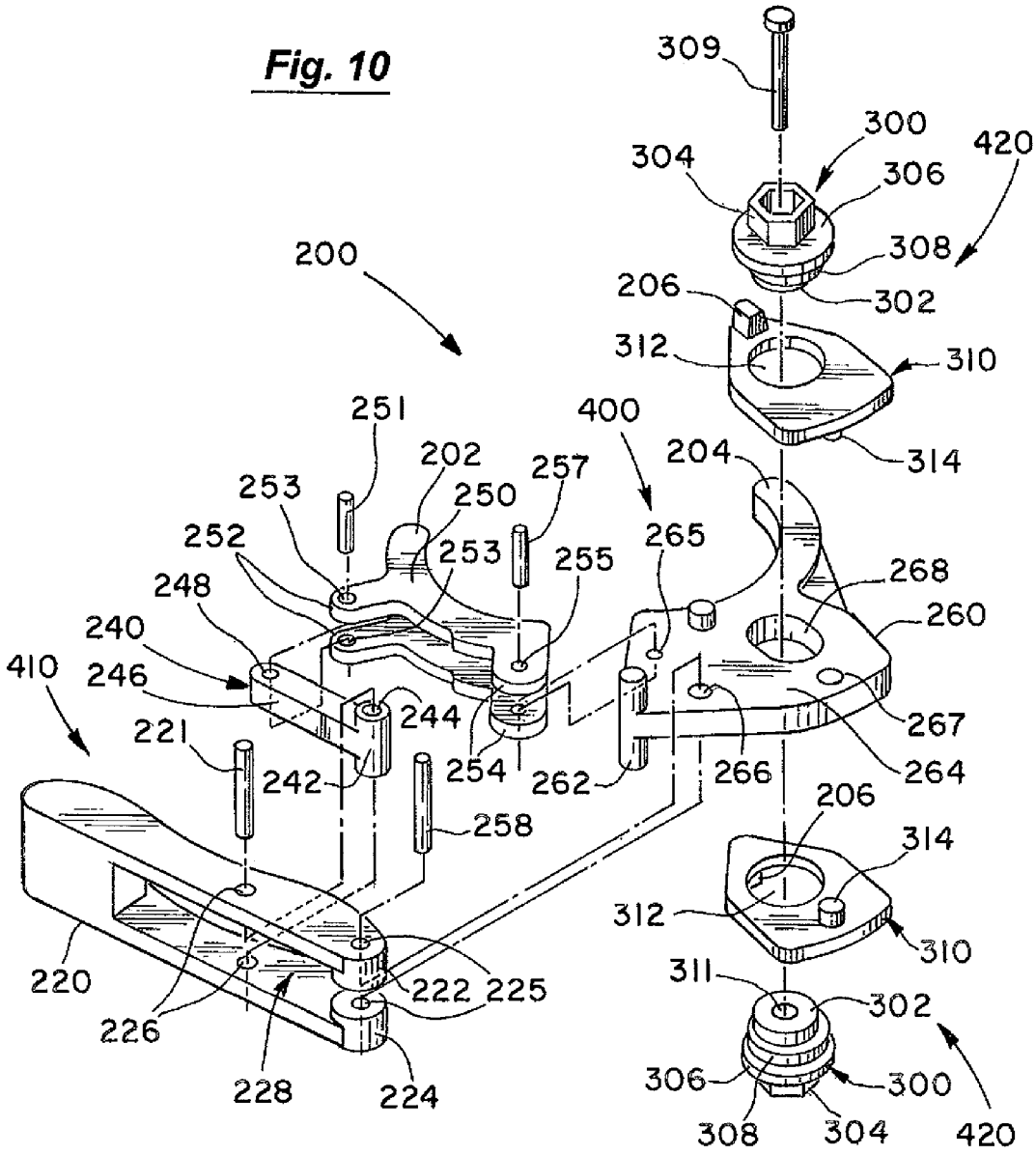
FIG. 10 is an exploded perspective view of the tool of the invention showing the various components.

In FIG. 10, the details of the tool 200 are shown. The lever 410 includes handle 220 and link 240. The handle 220 has two opposing forks 222 and 224 with formed holes 225 and with formed holes 226. Link 240 has an integral post 242 with a formed hole 244 at one end and an elongated portion 246 with a formed hole 248 at the opposing end. The post 242 is connected to the handle 220 with a pin 221 through holes 226 and 244 which permits link 240 to pivot about pin 221 in the slot 228.

The clamp 400 includes clamp plate 250 and clamp body 260. Clamp plate 250 is shown having the jaw 202 portion and two opposing pivot protrusions 252 and 254 with formed holes 253 and 255 respectively. Pivot protrusions 252 receive the end of elongated portion 246 of link 240 so that a pin 251 connects link 240 to clamp plate 250 between pivot protrusions 252 in holes 248 and 253 respectively. The link 240 when connected pivots with respect to clamp plate 250.

A clamp body 260 of clamp 400 is shown having the jaw portion 204 extending in an arcuate shape corresponding to the outer surface 62 or the mast pipe 60 at one end and a post 262 at the opposing end. A body portion 264 is integrally formed there between. The body portion 264 has formed holes 265, 266, 267, and 268. The body portion 264 passes between the pivot protrusions 254 and a pin 257 connects the clamp plate 250 to the clamp body 260. Once connected, the clamp plate 250 pivots about pin 257 with respect to the clamp body 260. The body portion 264 passes through the opposing forks 222 and 224 of the clamp lever 220 and a pin 258 connects the handle 220 through holes 225 and 266 to the clamp body 260. Once connected, the handle 220 pivots about pin 258 with respect to the clamp body 260.

The pair of opposing jaws 202 and 204 can have gripping surfaces (not shown) to aid in gripping the mast pipe 60.

The azimuth cam 420 includes two adjusters 300 and two cam plates 310 as shown. Each adjuster 300 has a bottom circular portion 302, a top nut portion 304, a washer portion 306 and an off centered cam portion 308. Each cam plate 310 has a formed circular hole 312, a post 314, and the protrusion 206. The post 314 of each cam plate engages the formed hole 267 of the clamp body 260 so that each cam plate 310 is properly oriented on opposing sides of the cam plate 310. The off centered cam portion of each adjuster 300 enters formed hole 312. The washer portion 306 sits on the cam plate 310. A rivet 309 passes through a formed hole 311 in each nut 304 to firmly hold each washer portion 306 of each cam nut 300 against opposing sides of clamp body 260. The adjusters 300 directly oppose each other on the clamp body 260. The posts portions 314 engage the hole 267 and allow the cam plate 310 to pivot about post 314. The protrusions 206 located on opposing sides of the cam plate 310 are now precisely positioned on the tool 200.

In summary of FIG. 10, the tool 200 has a clamp 400 with opposing jaws 202 and 204 for clamping around the mast pipe 60. The clamp 400 includes the clamp plate 250 and the clamp body 260. The tool 200 has a clamp lever 410 including handle 220 and link 240 connected to the clamp 400 for opening and closing the opposing jaws 202 and 204 about the mast pipe 60. Finally, the tool 200 has an azimuth cam 420 including the cam nut 300, and the cam plate 310 having the protrusion 206, connected to the clamping mechanism. When the cam nut 300 is turned, the protrusion 206 rotates the mast clamp 70 to finely adjust the azimuth of the satellite antenna system 100.

Figure 11B:
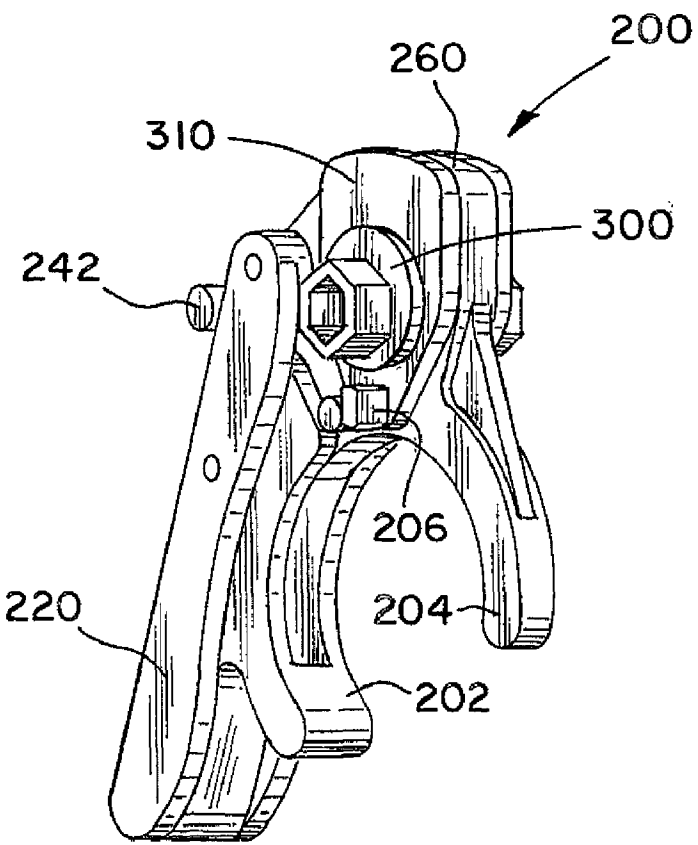
FIGS. 11(*a*) and 11(*b*) show symmetrical sides of the tool of the invention.
Figure 11A:
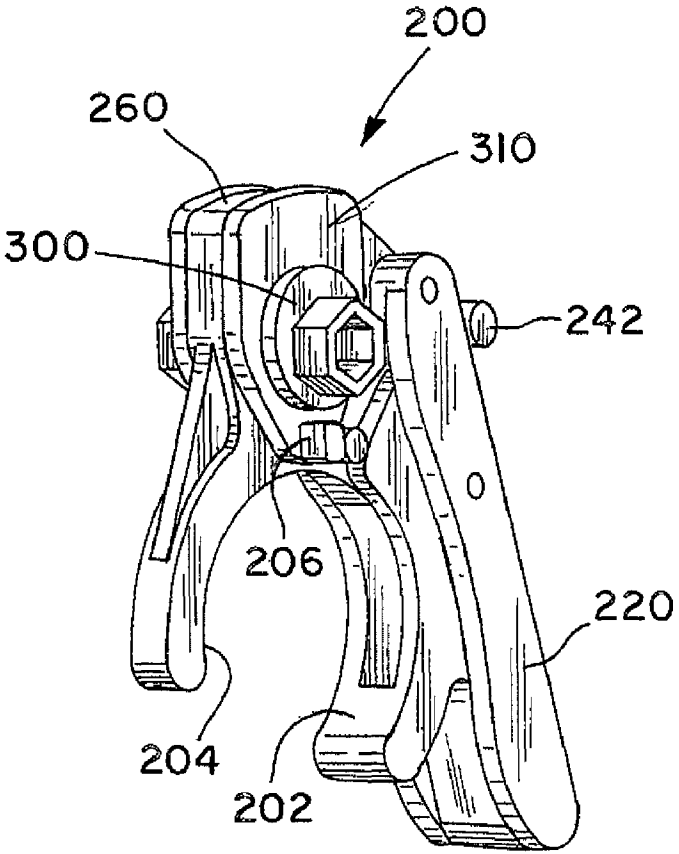

In FIGS. 11(*a*) and 11(*b*), the tool 200 is shown with the opposing sides identical in shape and construction. There is a cam plate 310 and a cam nut 300 on both sides of the clamp body 260. This design feature allows the tool 200 to be fastened to the mast pipe 60 with either side up and the tool can be used from the top or bottom and from the left or right. Such flexibility speeds up azimuth fine tuning by the installer. As an alternative, the tool can have a single cam nut 300 and a single cam plate 310 only on one side. The other side would have a retaining plate engaging the rivet 309. This results in a lower cost tool.

Figure 12:
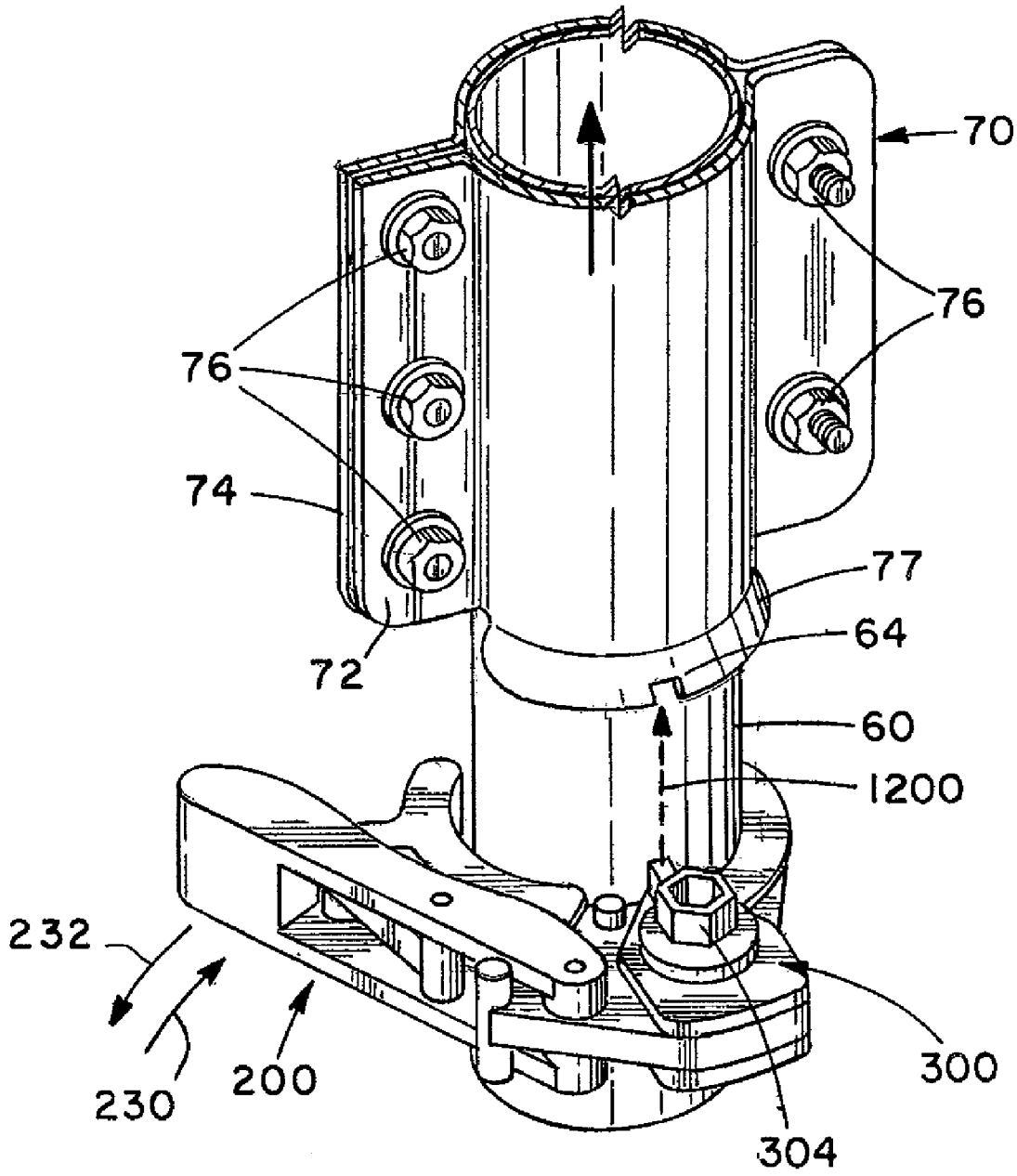
FIG. 12 is a perspective view illustrating the movement of the tool protrusion to the mast clamp slot.

FIG. 12 illustrates the use of the tool 200. The mast clamp 70 is affixed to the mount 20. The installer places the mast clamp 70 of the antenna 100 on the end of the mast pipe 60 and manually points the reflector in the general direction of operation. Bolts/nuts 76 are slightly tightened, but are still loose in order to hold the two sides 72 and 74 to the mast post 60. The installer, then places the tool 200 onto the mast pipe 60 and the protrusion 206 is moved along line 1200 towards the mast pipe 60 and into slot 64 of skirt 77 of mast clamp 70. The handle 220 is moved in direction 230 to hold the tool 200 firmly against the mast pipe 60 (see FIG. 4). The installer uses a conventional wrench to turn the cam nut 304 to the left or to the right to finely adjust azimuth (see arrow 1110 in FIG. 9). Turning the cam nut 304 of adjuster 300 turns the mast clamp 70 slowly and easily into the final adjusted location. When the azimuth is adjusted to a fine tuned final position, the bolts/nuts 76 (FIG. 5) are tightened and the handle 220 is moved in direction 232 to release the tool 200 from the mast pipe 60.

Figure 14:
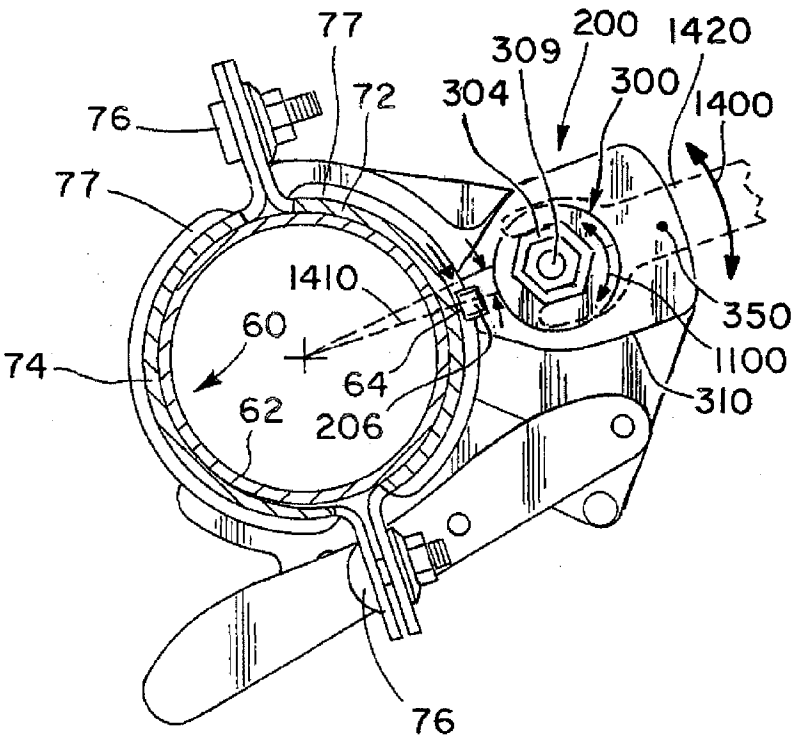
FIG. 14 is a top view of the tool turned to a zero degree position.
Figure 13:
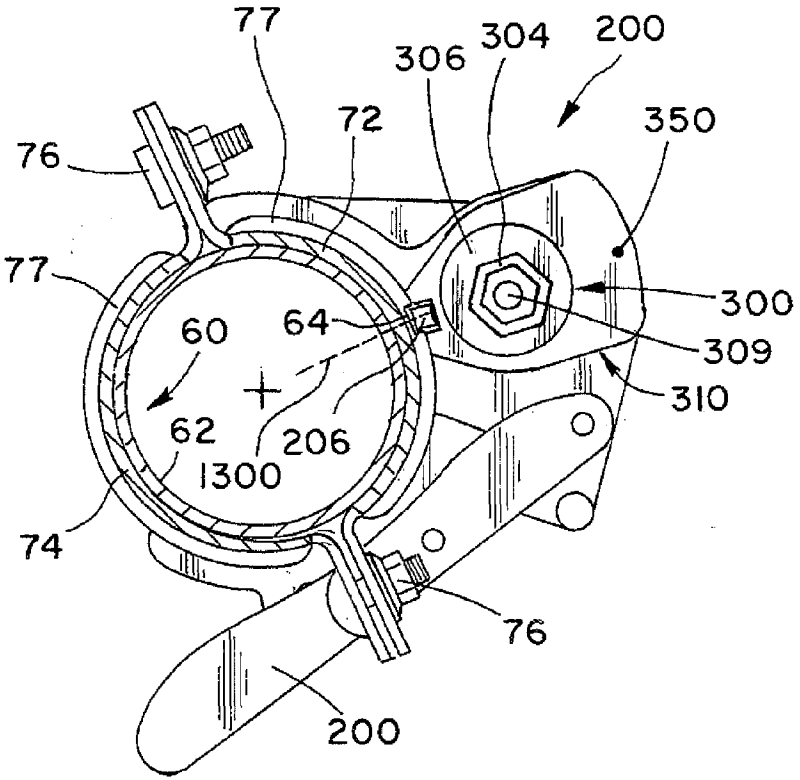
FIG. 13 is a top view of the tool turned to a 180 degree position.

The tool 200 is shown with the cam nut 300 turned to be at 180 degrees rotation in FIG. 13 and turned to be at 0 degrees rotation in FIG. 14. The nut 304 is offset on the washer 306 and when turned operates the cam 308 against the inside of the circular hole 312 of the cam plate 310. The cam plate 310 rotates about post 314 which forms a pivot point 350. The protrusion 206 position at 180 and 0 degrees is shown. In FIG. 13, the dotted line 1300 shows the protrusion 206 at the 180 degree position. In operation, movement of the adjuster 300 in direction of arrow 1400 through use of a wrench 1420 as shown in FIG. 14 causes the cam plate 310 to pivot about point 350. This in turn, moves the protrusion 206 in the slot 64 of the mast clamp 70 to the zero degree position 1410 which forces rotation of the mast clamp 70 about the axis of the mast pipe 60 in the azimuth direction. The installer, using a wrench 1420 on the adjuster 300 and turning the adjuster 300 in the directions of arrow 1100 will cause the cam plate 310 to rotate the mast clamp 70 a much smaller number of degrees thus providing a large ratio (such as 20:1) of movement giving the installer the ability to fine tune azimuth position of the mast clamp 70 (and thus the satellite). When the ratio is 20:1 as provided herein, for every twenty degrees of wrench movement, the azimuth is shifted about one degree. It is understood that any suitable ratio may be designed in based on pivot location, size of cam and cam plate, mast pipe diameter, etc.

Figure 15:
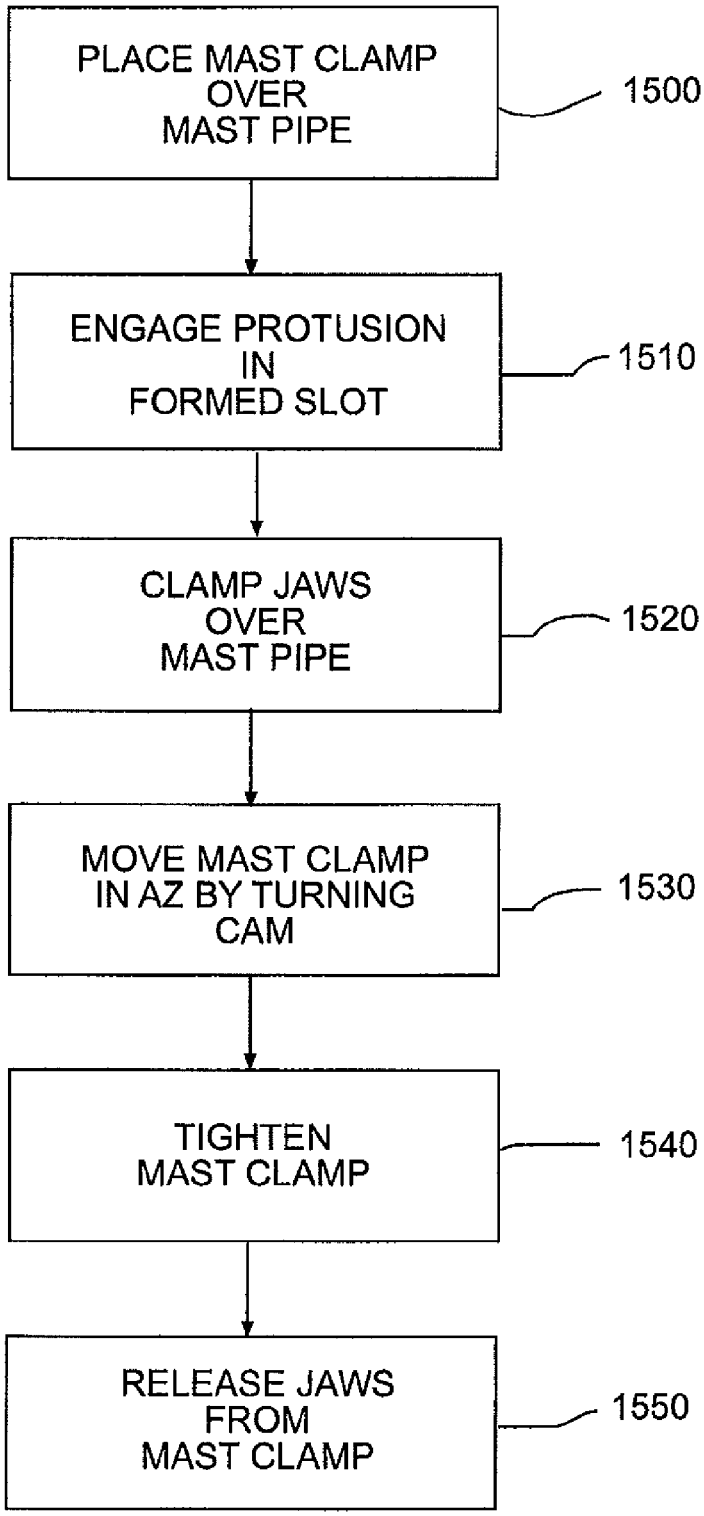
FIG. 15 sets forth the method of the invention.

The method of the invention discussed above is illustrated in FIG. 15. The method uses tool 200 to provide fine tuning of azimuth for a satellite dish antenna placed on a mast pipe 60. In step 1500, the installer places the mast clamp 70 over the mast pipe 60. The mast clamp 70 is affixed to the mount 20 so as the mast clamp 70 rotates on the mast pipe 60, the dish 50 connected to the mount 20 rotates in the azimuth direction. In step 1500, the approximate azimuth position is first manually obtained by the installer rotating the mount. In step 1510, the installer engages the protrusion 206 in the formed slot 64 and in step 1520 operates the lever to close the opposing jaws 202, 204 of the tool 200 around the mast pipe 60 to hold the protrusion 206 in the formed slot 64. Using a wrench 1420 in step 1530, the installer turns the cam nut 304 of adjuster 300 to move the mast clamp 70 in the azimuth direction to obtain a desired fine tune azimuth position. In step 1540, the mast clamp 70 is tightened and secured (firmly attached) to the mast clamp 60. And, in step 1550, the lever opens the opposing jaws 202, 204 and the tool 200 is released from the mast pipe 60. The tool 200 of the invention can also be used in iterative azimuth adjustment conventional processes.

Variations to the tool 200 of the invention include the following. A hex nut 304 is shown, but any mechanical design can be used to affect rotation in the azimuth cam 420 such as a recess or, receiving, for example, an Allen wrench, an extending rod replacing the cam nut 304 with a perpendicular hole there through receiving the shaft of a tool such as a Phillips screwdriver, etc.

The above disclosure sets forth a basic embodiment of the invention described in detail with respect to the accompanying drawings with a number of variations discussed.

Certain precise dimension values have been utilized in the specification. However, these dimensions do not limit the scope of the claimed invention and that variations in angles, spacings, dimensions, configurations, and dipole shapes can occur.

It is noted that the terms "preferable" and "preferably," are given their common definitions and are not utilized herein to limit the scope of the claimed disclosure. Rather, these terms are intended to highlight alternative or additional features that may or may not be utilized in a particular embodiment of the present disclosure.

For the purposes of describing and defining the present disclosure it is noted that the term "substantially" is given its common definition and it is utilized herein to represent the inherent degree of uncertainty that may be attributed to any shape or other representation.

Those skilled in this art will appreciate that various changes, modifications, use of other materials, other structural arrangements, and other embodiments could be practiced under the teachings of the invention without departing from the scope of this invention as set forth in the following claims.

We claim:

1. A fine azimuth adjustment tool for a satellite antenna system, said satellite antenna system having at least a mast clamp over a mast pipe, said mast clamp connected to said satellite antenna system, said fine azimuth adjustment tool comprising:

a clamp having a pair of opposing jaws for clamping around said mast pipe;

a lever connected to said clamp for opening and closing said opposing jaws about said mast pipe;

an azimuth cam having a protrusion and an adjuster, said protrusion engaging a formed slot at the bottom of said mast clamp when said lever closes said opposing pair of jaws over said mast pipe, said protrusion rotating said mast clamp about said mast pipe to provide fine azimuth adjustment to said satellite antenna system when said adjuster is turned, said protrusion in said formed slot holding said mast clamp on said mast pipe at a desired fine adjustment azimuth position when said mast clamp is firmly attached to said mast pipe, said lever opens said opposing pair of jaws to release said fine azimuth adjustment tool from said mast pipe after said attachment.

2. The fine azimuth adjustment tool of claim 1 wherein said clamp comprises:

a clamp plate having a first jaw in said pair of opposing jaws;

a clamp body having a second jaw in said pair of opposing jaws;

said clamp plate pivotally connected to said clamp body, said lever pivotally connected to said clamp plate and to said clamp plate to open and close said pair of opposing jaws.

3. The fine azimuth adjustment tool of claim 1 wherein said lever comprises:

a handle; and a link, said handle and link pivotally connected to said clamp to open and close said pair of opposing jaws.

4. The fine azimuth adjustment tool of claim 1 wherein said azimuth cam comprises:

a cam plate, said protrusion integrally formed on said cam plate, said cam plate having a formed hole and a post;

said adjuster having a nut integrally formed on one side of a washer and a cam integrally formed on the opposing side of said washer.

5. The fine azimuth adjustment tool of claim 1 wherein said clamp further comprises:

a clamp plate having a first jaw in said pair of opposing jaws;

a clamp body having a second jaw in said pair of opposing jaws;

said clamp plate pivotally connected to said clamp body, said lever pivotally connected to said clamp plate and to said clamp plate to open and close said pair of opposing jaws;

and wherein said lever further comprises:

a handle;

a link, said handle and link pivotally connected to said clamp to open and close said pair of opposing jaws.

6. The fine azimuth adjustment tool of claim 1 further comprising a second azimuth cam having a second protrusion and a second adjuster connected to said clamp on the side opposite said azimuth cam.

7. A method for fine tuning azimuth in a satellite dish antenna placed on a mast pipe, said method comprising:

engaging a protrusion on a tool in a formed slot of a mast clamp of the satellite dish antenna;

clamping a pair of opposing jaws of the tool around the mast pipe to hold the protrusion in the formed slot;

moving the mast clamp in the azimuth direction when a cam in the tool connected to the protrusion is turned to fine tune the azimuth of the satellite dish antenna;

tightening the mast clamp to the mast pipe after fine tuning of the azimuth occurs;

releasing the opposing jaws of the tool from the mast pipe to remove the tool.

* * * * *